US007685975B2

(12) United States Patent
Springer

(10) Patent No.: US 7,685,975 B2
(45) Date of Patent: Mar. 30, 2010

(54) INTERNAL COMBUSTION ENGINE TWIN POWER UNIT HAVING AN OSCILLATING CYLINDER

(76) Inventor: Joseph E. Springer, 11247 Monte Vista, Montclair, CA (US) 91763

( * ) Notice: Subject to any disclaimer, the term of this patent is extended or adjusted under 35 U.S.C. 154(b) by 0 days.

(21) Appl. No.: 12/055,989

(22) Filed: Mar. 26, 2008

(65) Prior Publication Data

US 2009/0159023 A1 Jun. 25, 2009

Related U.S. Application Data

(60) Provisional application No. 61/016,454, filed on Dec. 22, 2007.

(51) Int. Cl.
*F02B 75/18* (2006.01)

(52) U.S. Cl. ..... 123/52.5; 123/52.2; 123/90.39

(58) Field of Classification Search ..... 123/42, 123/44 C, 44 D, 51 R, 51 AA, 51 AC, 51 B, 123/51 BB, 51 BC, 51 BD, 52.1–52.3, 53.1, 123/197.1, 197.4, 197.3, 74 R, 74 A, 74 AC
See application file for complete search history.

(56) References Cited

U.S. PATENT DOCUMENTS 347,603 A * 8/1886 Dewhurst ..... 123/42
788,402 A * 4/1905 Haselwander ..... 123/52.3
1,135,365 A * 4/1915 Dock ..... 123/42
1,277,238 A * 8/1918 Michaud ..... 123/42
1,785,176 A * 12/1930 Berner et al. ..... 123/42
2,706,970 A * 4/1955 Rinne ..... 123/51 B
3,537,437 A * 11/1970 Ana et al. ..... 123/192.1
3,911,753 A * 10/1975 Daub ..... 74/40
4,450,794 A * 5/1984 Pailler ..... 123/74 R
4,506,634 A * 3/1985 Kerrebrock ..... 123/68
4,767,287 A * 8/1988 Marks ..... 417/461
5,275,134 A * 1/1994 Springer ..... 123/42

* cited by examiner

*Primary Examiner*—Michael Cuff
*Assistant Examiner*—Hung Q Nguyen
(74) *Attorney, Agent, or Firm*—Patent Venture Group; Joe A. Brock, II

(57) ABSTRACT

An internal combustion engine twin power unit that includes a crossover passage fluidly connecting a first cylinder to a second cylinder such that an air-fuel mixture introduced in the first cylinder is transferred to the second cylinder via the crossover passage, and wherein an ignition in any cylinder causes combustion of the air-fuel mixture in both cylinders via the crossover passage. Also included is a rod assembly, which is connected to the first piston and the second piston which are disposed in the cylinders. The rod assembly rigidly fixes the first piston and the second piston in a fixed spatial relation to each other. In addition, an intake port is included that is in fluid communication with both the first cylinder and the second cylinder.

11 Claims, 9 Drawing Sheets

INTERNAL COMBUSTION ENGINE TWIN POWER UNIT HAVING AN OSCILLATING CYLINDER

CROSS REFERENCE TO RELATED APPLICATIONS

This application claims the benefit of U.S. Provisional Patent Application having Ser. No. 61/016,454, filed on Dec. 22, 2007, entitled "Internal Combustion Engine Twin Power Unit Having an Oscillating Cylinder," by inventor Joseph E. Springer, which is hereby incorporated by reference.

BACKGROUND OF THE INVENTION

1. Field of the Invention

This invention relates generally to internal combustion engines, and more particularly to an oscillating cylinder twin power unit for an internal combustion engine.

2. Description of the Related Art

To derive power, conventional internal combustion engines ignite a compressed air-fuel mixture in a combustion chamber. The ignition of the compressed air-fuel mixture generates force against a piston, which is linked to a crankshaft in a manner such that the motion of the piston is converted into rotational motion of a drive shaft. More particularly, in operation air and fuel is provided to a combustion cylinder and compressed by the piston. Once compressed, the air-fuel mixture is ignited powering the piston and the crankshaft. The exhaust is then expelled from the cylinder.

Internal combustion engines generally can be either two-stroke or four-stroke engines. In general, two-stroke engines complete the power cycle during a single reciprocation of the piston, that is, one revolution of the crankshaft. Four-stroke engines generally require two reciprocations of the piston, or two revolutions of the crankshaft. Two-stroke engines offer certain advantages over four-stroke engines because the former produces power strokes twice as often as compared to the four-stroke engine. This permits two-stroke engines to be smaller in size and lighter in weight than four-stroke engines with a comparable power output. Two-stroke engines are also less expensive to manufacture and build because they require fewer parts that are subject to wear, breakdown and replacement.

Conventional two-stroke engines, however, are generally not as efficient as four-stroke engines because two-stroke engines do not effectively remove all of the exhaust gases from the combustion chamber before the next power producing cycle. For example, FIG. 1 is an illustration showing a prior art two-stroke engine 100. The prior art two-stroke engine 100 includes an enclosed crankcase 102 below a cylinder 104 housing a piston 106. The piston 106 is connected to a crankshaft 108 via a crank throw 110 and connecting rod 112. To allow the piston 106 to travel up and down within cylinder 104, the piston 106 is connected to the connecting rod 112 via a wrist pin 114. As illustrated in FIG. 1, in the prior art two-stroke engine 100, both the intake port 116 and the exhaust port 118 are open at the same time to enable the new air-fuel mixture to flow into the combustion chamber and to allow the escape of the exhaust gases. The concurrent opening of the intake port 116 and exhaust port 118 allows the fresh air-fuel mixture to purge the exhaust gases out of the combustion chamber through the exhaust port 118. This is disadvantageous because some of the fresh air-fuel mixture escapes through the exhaust port 118 reducing engine efficiency by failing to utilize all of the fresh air-fuel mixture during the combination process. In addition, some of the exhaust gases mix with the incoming fresh air-fuel mixture which further reduces engine efficiency because noncombustible gases remain in the combustion chamber during the subsequent power cycle.

Conventional internal combustion engines, including the prior art two-stoke engine 100 illustrated in FIG. 1, also lose power and efficiency because the reciprocating piston 106 is attached to the crankshaft 108 by the connecting rod 112 and the wrist pin 114 to translate linear reciprocating motion of the piston 106 into rotational movement of the crankshaft 108. The use of the connecting rod 112 and wrist pin 114 results in uneven and excessive wear to the piston 106 and cylinder wall because lateral forces are transmitted through the connecting rod 112 in directions other than through the centerline of the piston 106. In a typical engine, the cylinders are held stationary in the engine block and the pistons 106 are connected to the rotating crankshaft 108 by the connecting rod 112 which pivots about the wrist pin 114. When the piston 106 is in any position other than the top dead center or bottom dead center of the cylinder 104, the force acting through the centerline of the piston 106 is not aligned with the axis of rotation of the crankshaft 108. Transverse or lateral force vectors, which cause uneven wear of the piston 106, are created because the force is not acting directly upon the crankshaft 108.

In view of the foregoing, there is a need for an internal combustion engine that does not lose power due to non-alignment of the axis of rotation of the crankshaft and the connecting rod. In addition, the internal combustion engine should prevent wasteful air-fuel mixture escaping the system prior to combustion.

SUMMARY OF THE INVENTION

Broadly speaking, the present invention addresses these needs by providing an oscillating cylinder twin power unit for an internal combustion engine. Broadly speaking, embodiments of the present invention utilize parallel oscillating cylinders coupled to a rod assembly, which powers a crankshaft without requiring a wrist pin. In addition, a trunnion mount allows the twin power unit to oscillate back and forth across a small arc while tracking the rotational movement of the point of contact between the base on the rod assembly and the crankshaft. For example, in one embodiment, an internal combustion engine twin power unit is disclosed. The internal combustion twin power unit includes a first cylinder and a second cylinder connected to the first cylinder via a crossover passage, where the crossover passage fluidly connects the first cylinder to the second cylinder. In addition, a rod assembly is included that is connected to a first piston and a second piston, which are disposed within the respective cylinders. The rod assembly rigidly fixes the first piston and the second piston in a fixed spatial relation to each other. The crossover passage allows, for example, an air-fuel mixture introduced in the first cylinder to be transferred to the second cylinder via the crossover passage, and an ignition in any cylinder will cause combustion of the air-fuel mixture in both cylinders via the crossover passage. The twin power unit can further include an intake port in fluid communication with the first cylinder and an exhaust port in fluid communication with the second cylinder. In this manner, air supplied to the first cylinder via the intake port is supplied to the second cylinder via the crossover passage. Here, air can be supplied to the first cylinder when the first piston clears the intake port, and the air can assist in expelling combustion exhaust gases from both cylinders out the exhaust port. The spatially fixed pistons allow, for example, both pistons to compress air present in the cylinders at essentially the same time, which further is facilitated by the first piston covering the intake port and the second piston covering the exhaust port during compression. In a similar manner, the combustion in both cylinders drives both the pistons towards lower portions of the cylinders essentially simultaneously. The twin power unit further includes a trunnion mount that allows the twin power unit to oscillate such that a centerline of the pistons is at all times aligned with a crank throw of a crankshaft.

An additional internal combustion engine twin power unit is disclosed in a further embodiment. In this embodiment, the internal combustion engine twin power unit includes a crossover passage fluidly connecting the first cylinder to the second cylinder such that an air-fuel mixture introduced in the first cylinder is transferred to the second cylinder via the crossover passage, and wherein an ignition in any cylinder causes combustion of the air-fuel mixture in both cylinders via the crossover passage. Also included is a rod assembly, which is connected to the first piston and the second piston which are disposed in the cylinders. As above, the rod assembly rigidly fixes the first piston and the second piston in a fixed spatial relation to each other. In addition, an intake port is included that is in fluid communication with both the first cylinder and the second cylinder. To control air passage within the intake port, a one-way valve is included. In this manner, air drawn into the first cylinder and the second cylinder via the intake port below the first piston and the second piston is prevented from escaping either cylinder via the intake port during downward motion of the first piston and the second piston. The twin power unit can further include an intake charge passage disposed between the intake port and first cylinder and between the intake port and the second cylinder. The intake charge passage is configured such that the first piston clears an area of the intake charge passage before the second piston during downward motion of the first piston and the second piston. In this manner, air compressed below the first piston and the second piston during downward motion of the pistons escapes into the first cylinder above the first piston via the intake charge passage when the first piston clears an area of the intake charge passage. In addition, an exhaust port can be included that is in fluid communication with the second cylinder. Here, compressed air escaping into the first cylinder via the intake charge passage purges combustion exhaust gases from both cylinders out the exhaust port.

In a further embodiment, an internal combustion engine twin power unit having a first cylinder and a second cylinder and an exhaust valve is disclosed. As above, the internal combustion engine twin power unit includes a crossover passage fluidly connecting the first cylinder to the second cylinder, wherein an air-fuel mixture introduced in the first cylinder is transferred to the second cylinder via the crossover passage, and wherein an ignition in any cylinder causes combustion of the air-fuel mixture in both cylinders via the crossover passage. Also as above, a rod assembly is included that is connected to the pistons and rigidly fixes the pistons in a fixed spatial relation to each other. A trunnion mount is included that allows the twin power unit to oscillate such that a centerline of the pistons is at all times aligned with a crank throw of a crankshaft. The oscillating motion produced via the trunnion is utilized to control the operation of an exhaust valve controlling exhaust gas flow from the second cylinder. In particular, a rocker assembly coupled to the exhaust valve controls the exhaust valve based on the oscillation of the twin power unit. In one embodiment, a rocker roller rotatebly attached the rocker assembly moves along a ramp cam having a high end and a low end during oscillation of the twin power unit. In this manner, oscillation of the twin power unit during downward motion of the pistons causes the rocker roller to move toward the high end of the ramp cam, which causes the rocker assembly to open the exhaust valve. Conversely, oscillation of the twin power unit during upward motion of the pistons causes the rocker roller to move toward the low end of the ramp cam, which causes causes the rocker assembly to close the exhaust valve.

In this manner, embodiments of the present invention advantageously allow power to be applied to crankshaft without the need of a wrist pin via the trunnion mount which allows the twin power unit to oscillate. In addition, the intake charge air compression and purge allows the efficient expulsion of combustion exhaust gases without the need of an external system. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for providing a twin power unit having an oscillating cylinders for an internal combustion engine. Broadly speaking, embodiments of the present invention utilize parallel oscillating cylinders coupled to a rod assembly, which powers a crankshaft without requiring a wrist pin. In addition, a trunnion mount allows the twin power unit to oscillate back and forth across a small arc while tracking the rotational movement of the point of contact between the base on the rod assembly and the crankshaft. Hence, the trunnion mount allows the twin power unit to oscillate such that the centerline of the pistons is at all times aligned with the crank throw of the crankshaft to eliminate lateral force vectors. Since the rod assembly directly connects the pistons to the crankshaft, there is no need for a wrist pin and connecting rod. Moreover, in one embodiment, a unique enclosed cylinder design is utilized to allow an intake air charge to be compressed beneath the pistons and later blasted into the cylinders above the pistons to purge combustion exhaust gases from the cylinders. As will be appreciated after a careful reading of the present disclosure, the twin power units described below can be utilized alone, or with multiple twin power units connected to the crankshaft.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
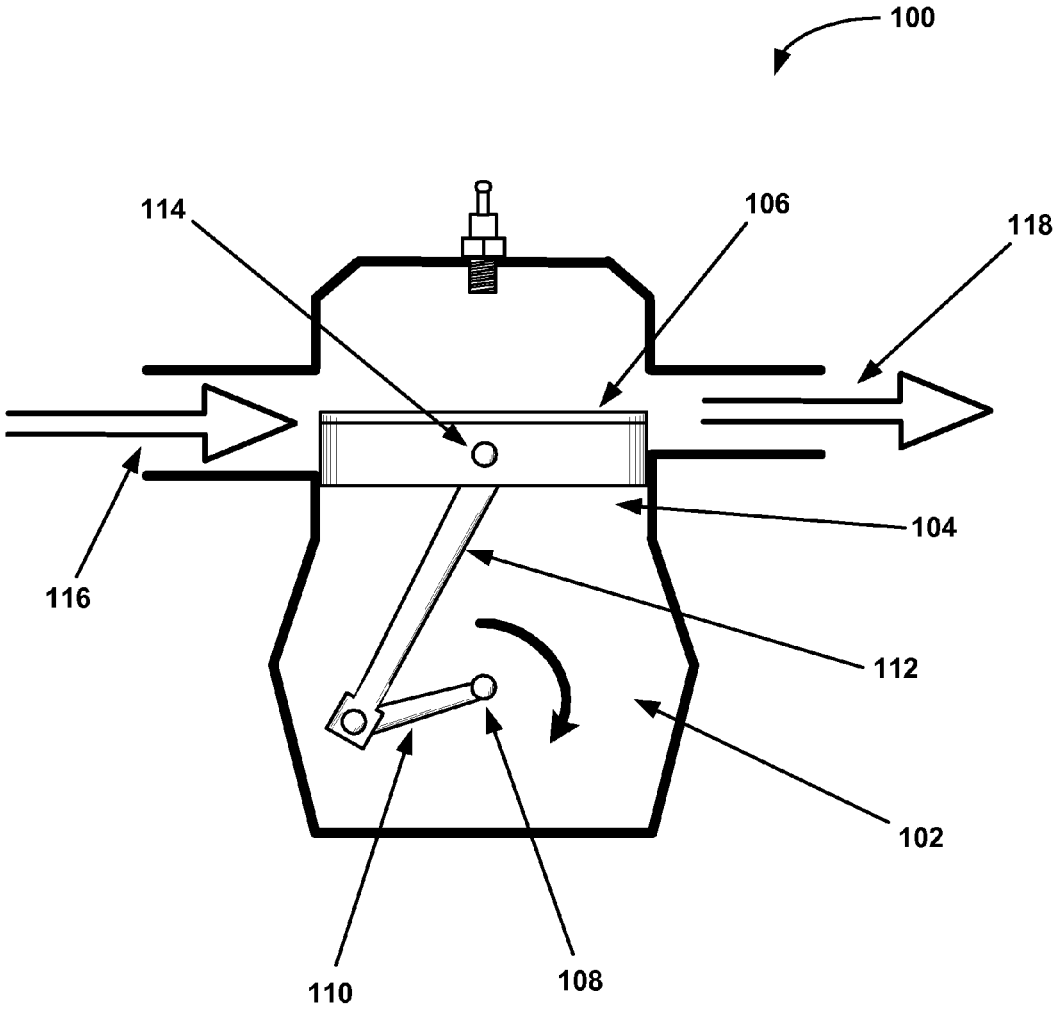
FIG. 1 (Prior Art)
FIG. 1 is an illustration showing a prior art two-stroke engine.
Figure 2:
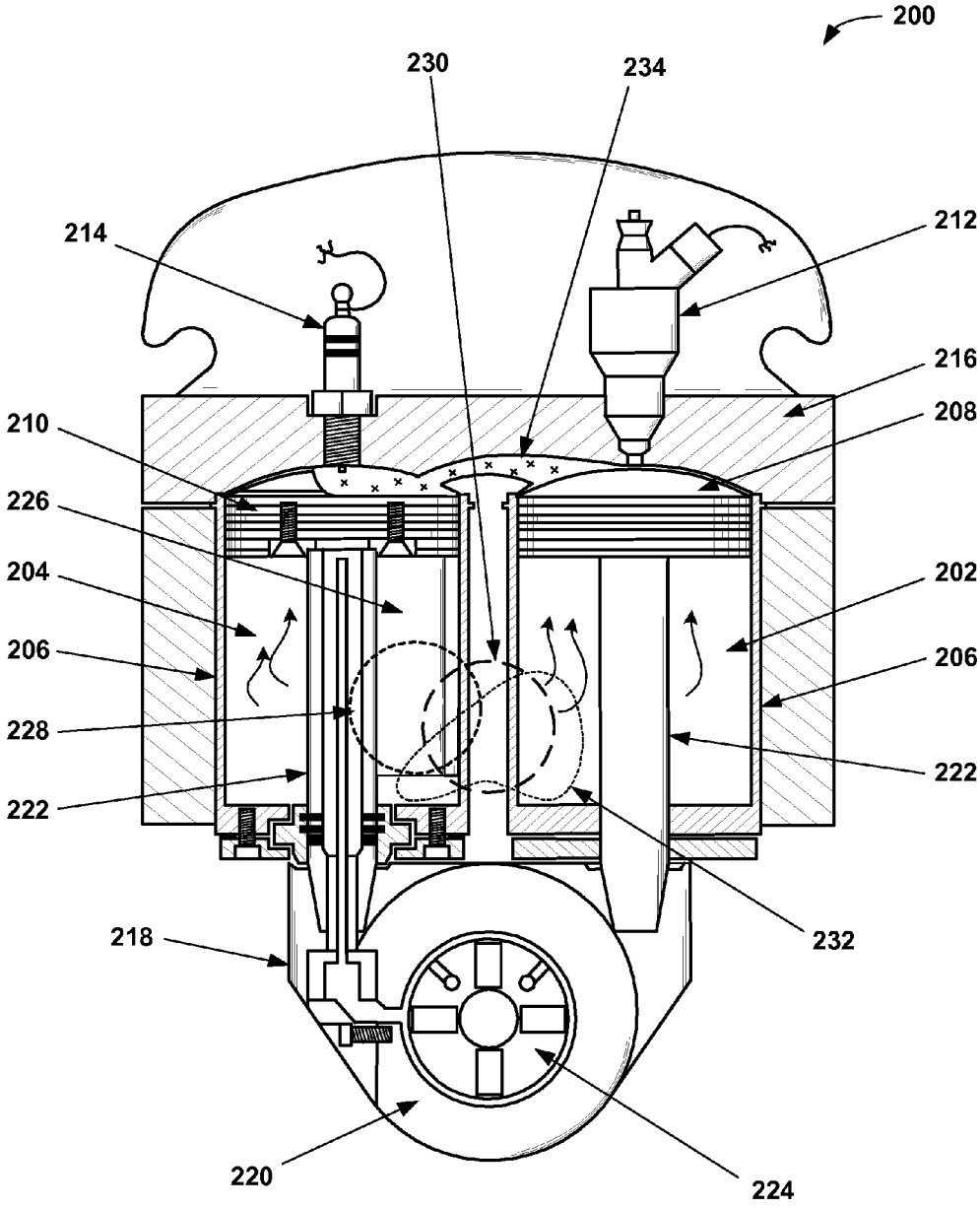
FIG. 2 is a diagram showing an oscillating cylinder twin power unit for an internal combustion engine, in accordance with an embodiment of the present invention.

FIG. 1 was described in terms of the prior art. FIG. 2 is a diagram showing an oscillating cylinder twin power unit 200 for an internal combustion engine, in accordance with an embodiment of the present invention. The exemplary twin power unit 200 of FIG. 2 includes an intake cylinder 202 and exhaust cylinder 204, each enclosing a piston sleeve 206. Located in the intake cylinder 202 is an intake piston 208, and disposed in the exhaust cylinder 204 is an exhaust piston 210. An exhaust piston skirt 226 is attached to the exhaust piston 210 to seal the exhaust port during the charge and power cycles as will be described in greater detail subsequently. In the embodiment of FIG. 2, a fuel injector 212 is situated above the intake cylinder 202 and a spark plug 214 is located above the exhaust cylinder 204, both of which being disposed in the cylinder head base 216. Fixed below the pistons 208 and 210 is a rod assembly 218, which includes a rod base bearing mount 220 connected to two tubular rod assemblies 222, and a crank assembly 224. Also illustrated in FIG. 2 are an exhaust port 228 connected to the exhaust cylinder 204 and an intake port 230 connected to the intake cylinder 202. The intake port 230 also is in fluid communication with an intake charge passage 232 that connects the bottom portions of the intake cylinder 202 and the exhaust cylinder 204. In addition, an air-fuel crossover passage 234 connects the top portions of the intake cylinder 202 and the exhaust cylinder 204. As will be described in greater detail subsequently, the air-fuel crossover passage 234 allows an air-fuel mixture introduced in the intake cylinder 202 to be transferred to the exhaust cylinder 204, and further allows an ignition in any cylinder to cause combustion of the air-fuel mixture in both cylinders.

Embodiments of the present invention provide twin power pistons (i.e., the intake piston 202 and exhaust piston 204) that fire simultaneously to drive a crankshaft via a one piece rod assembly 218, that rigidly fixes the intake piston and exhaust piston in a fixed spatial relation to each other. As will be described in greater detail below, the trunnion mounted cylinders allow the twin power unit 200 to rotate with the one piece rod assembly 218 allowing power transference without the need for a wrist pin. Moreover, the use of fully enclosed cylinders allows an intake charge without the need of an enclosed crankcase, which leads to oil mixing with the intake charge resulting in heavy emissions concerns.

In operation, the twin power unit functions utilizing three cycles: 1) charge cycle, 2) power cycle, and 3) purge cycle, which will be described with reference to FIG. 1 and FIG. 2. Referring to FIG. 1, during the charge cycle both the intake piston 208 and the exhaust piston 210 rise within the corresponding cylinders 202 and 204, compressing the air above the cylinders into the top portions of the cylinders 202 and 204. As the pistons 208 and 210 rise, the fuel injector 212 is timed to deliver fuel to the intake cylinder 202 creating an air-fuel mixture. Because the simultaneous compression currently occurring within the top portions of the cylinders 202 and 204, a swirling effect is created mixing the fuel with the compressed air, creating an air-fuel mixture that also flows into the top portion of the exhaust cylinder 204 via the air-fuel crossover passage 234.

In addition, as the intake piston 208 and exhaust piston 210 rise, the pistons move to reveal the intake charge passage 232. The rising movement of the intake piston 208 and exhaust piston 210 draws in an air intake charge from the intake port 230 and through the intake charge passage 232 into the bottom portions of the intake cylinder 202 and exhaust cylinder 204 beneath the pistons 208 and 210. Both the intake cylinder 202 and the exhaust cylinder 204 are fully enclosed, thus preventing the intake air from escaping. In addition, as will be described in greater detail subsequently, during the charge cycle the exhaust port 228 is covered by the exhaust piston skirt 226, preventing the intake air charge from escaping via the exhaust port 228.

The power cycle begins once the pistons reach the top of the cylinders at 12 o'clock and full compression is achieved, as illustrated in FIG. 2. The spark plug 214 ignites the compressed air-fuel mixture powering the pistons 208/210 and driving the pistons 208/210 and rod assembly 218 toward the crankshaft. During full compression, the compressed air-fuel mixture is present in the top portions of both the intake cylinder 202 and the exhaust cylinder 204, and also in air-fuel crossover passage 234. Hence, the spark plug 214 ignites the air-fuel mixture in the exhaust cylinder 202, which ignites the air-fuel mixture in the air-fuel crossover passage 234, which ignites the air-fuel mixture in the intake cylinder 202. As a result, both the exhaust piston 210 and the intake piston 208 are powered during the power cycle via the spark plug 214. As the pistons 208 and 210 travel downward within the cylinders, the pistons 208 and 210 begin to drive the air intake charge currently stored beneath the pistons back into the intake port 230 via the intake charge passage 232, as best depicted in FIG. 3.

Figure 3:
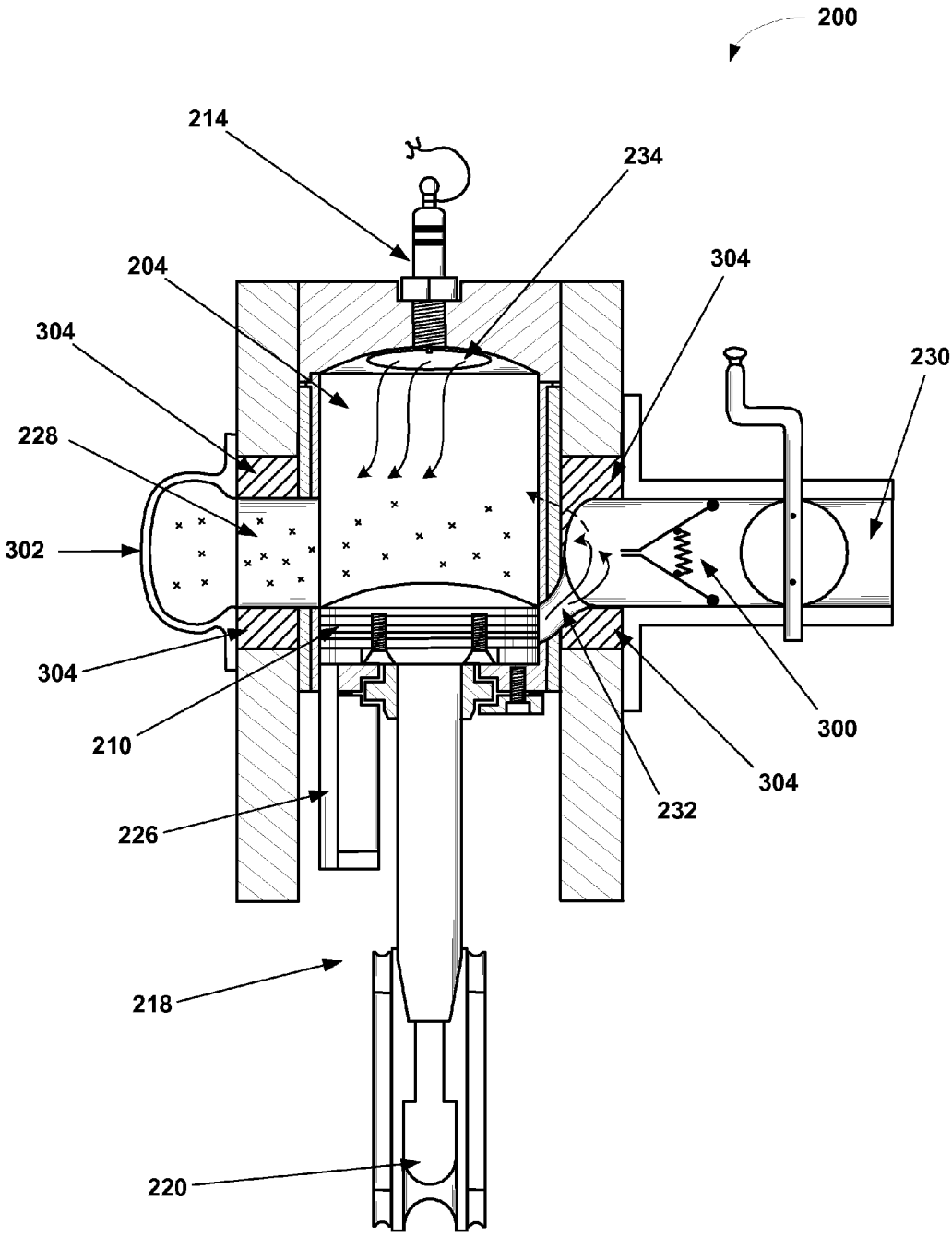
FIG. 3 is a side view of the twin power unit showing the exhaust cylinder, in accordance with an embodiment of the present invention.

FIG. 3 is a side view of the twin power unit 200 showing the exhaust cylinder 204, in accordance with an embodiment of the present invention. The purge cycle begins as the pistons 208 and 210 travel downward and the exhaust piston 210 begins to clear the exhaust port 228, when the crankshaft reaches about 3:30 and the twin power unit 200 rotates about the trunnion mount 304. As noted above, the downward motion of the pistons 208 and 210 drives the intake air present in both cylinders below the pistons 208 and 210 back into the intake port 230 via the intake charge passage 232. However, a one-way reed valve 300 present in the intake port 230 prevents the intake air from escaping out of the intake port 230. As a result, the downward motion of the pistons 208 and 210 compresses the intake air in the bottom portion of the cylinders 202 and 204 and portion of intake port 230 on the piston side of the reed valve 300.

Once the exhaust piston 210 begins to clear the exhaust port 228, the combustion exhaust gases from the power cycle begin to escape the exhaust cylinder 204 via the exhaust port 228 into the exhaust pipe 302. As the pistons 208 and 210 continue to travel downward, the intake piston 208 begins to reveal the intake charge passage 232. Once the top of the intake piston 208 drops below the top of the intake charge passage 232, the intake charge air compressed beneath the pistons 208 and 210, and in the portion of intake port 230 on the piston side of the reed valve 300, is blasted into the intake cylinder 202 above the intake piston 208.

The rapid intake charge air blast purges the combustion exhaust gases from the intake cylinder 202, through the air-fuel crossover passage 234, through the exhaust cylinder 204, and out the exhaust port 228. As will be appreciated by those skilled in the art after a careful reading of the present disclosure, the rapid intake charge air blast also purges the combustion exhaust gases from the air-fuel crossover passage 234 and the exhaust cylinder 204.

As the intake piston 208 and exhaust piston 210 begin to travel back upward, the intake charge air, forced via the upward motion of the pistons 208 and 210 further expels the combustion exhaust gases from the cylinders 202/204 and air-fuel crossover passage 234 out the exhaust port 228. In addition, another charge cycle begins with the fuel injector 212 delivering fuel to the intake cylinder 202, and the pistons 208/210 rising to reveal the intake charge passage 232, and thereby drawing in another air intake charge into the bottom portions of the intake cylinder 202 and exhaust cylinder 204 beneath the pistons 208 and 210. As mentioned above, the trunnion mounted cylinders of the embodiments of the present invention allow the twin power unit 200 to rotate with the one piece rod assembly 218 allowing power transference without the need for a wrist pin, as discussed next with reference to FIG. 4 and FIGS. 5A-5D.

Figure 4:
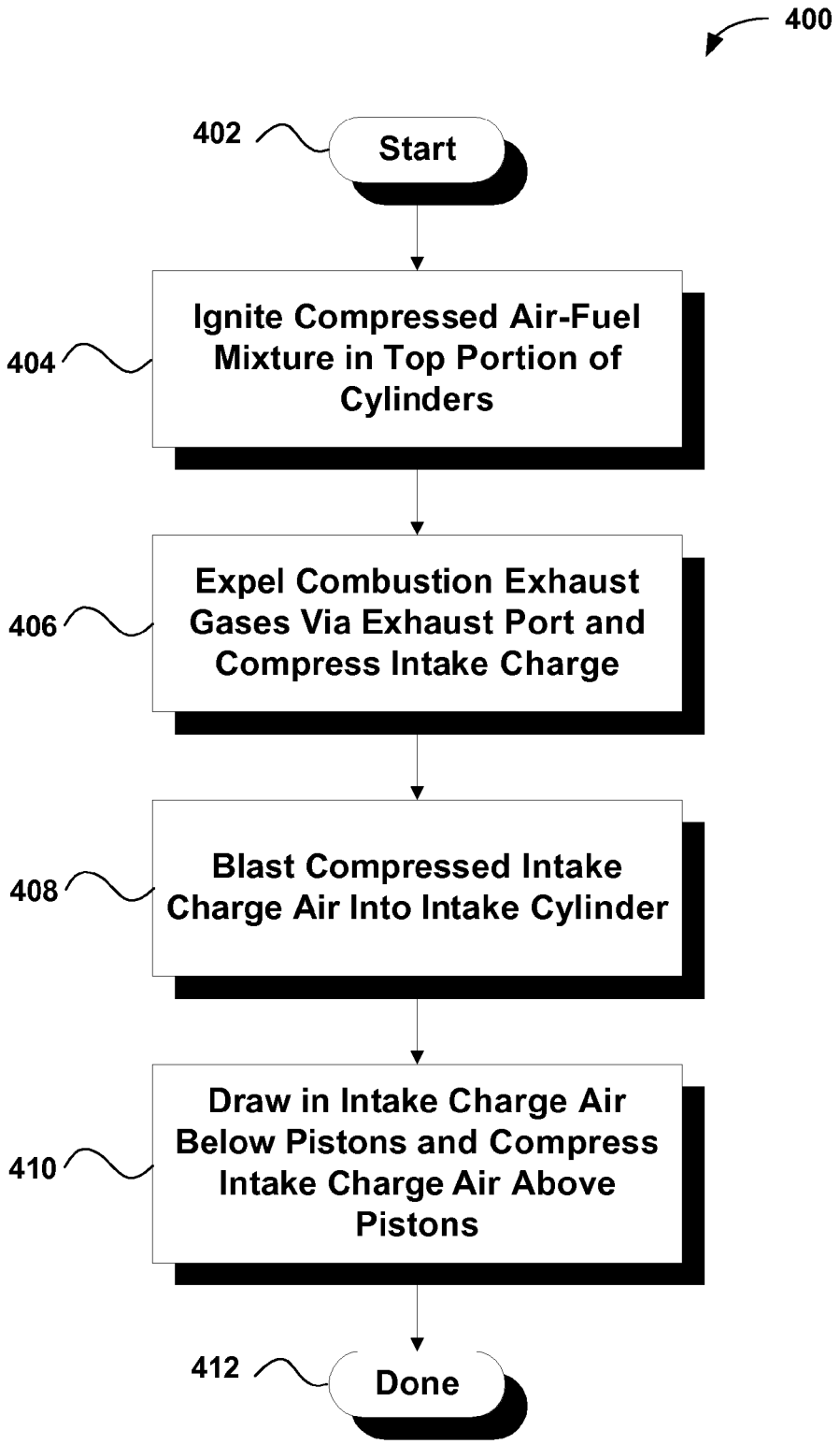
FIG. 4 is a flowchart showing a method of operation for the oscillating cylinder twin power unit, in accordance with an embodiment of the present invention.

FIG. 4 is a flowchart showing a method 400 of operation for the oscillating cylinder twin power unit 200, in accordance with an embodiment of the present invention. In an initial operation 402, engine preparation operations can be performed. Engine preparation operations can include, for example, determining the number of twin power units to include in the engine, calculating proper timing for the twin power units according to size and performance needs, and other engine preparation operations that will be apparent to those skilled in the art after a careful reading of the present disclosure.

Figure 5A:
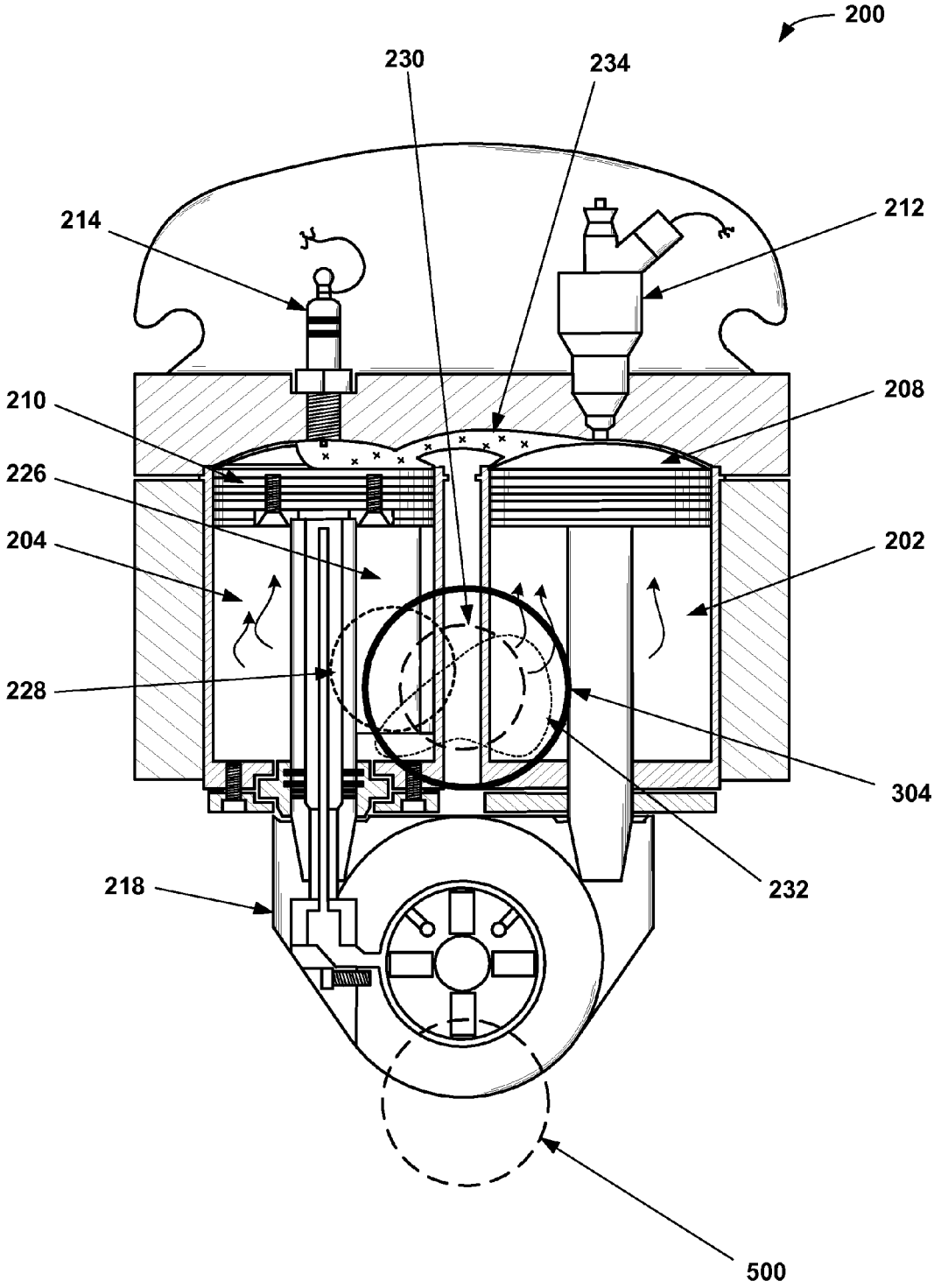
FIG. 5A illustrates a twin power unit during the beginning of a power cycle, in accordance with an embodiment of the present invention.

In operation 404, the air-fuel mixture present in the top portions of the intake cylinder and exhaust cylinder above the pistons is ignited utilizing a spark plug. FIG. 5A illustrates a twin power unit 200 during the beginning of a power cycle, in accordance with an embodiment of the present invention. The power cycle begins once the pistons 208/210 reach the top of the cylinders 202/204 at 12 o'clock with respect to the crankshaft indicated at 500. The spark plug 214 ignites the compressed air-fuel mixture powering the pistons 208/210, driving the pistons 208/210 and rod assembly 218 toward the crankshaft 500. In operation 404, the compressed air-fuel mixture is present in the top portions of both cylinders 202/204, and in air-fuel crossover passage 234. Hence, spark plug 214 ignites the air-fuel mixture present in the exhaust cylinder 204, air-fuel crossover passage 234, and intake cylinder 202, resulting in both the exhaust piston 210 and the intake piston 208 being powered during the power cycle via the spark plug 214.

Figure 5B:
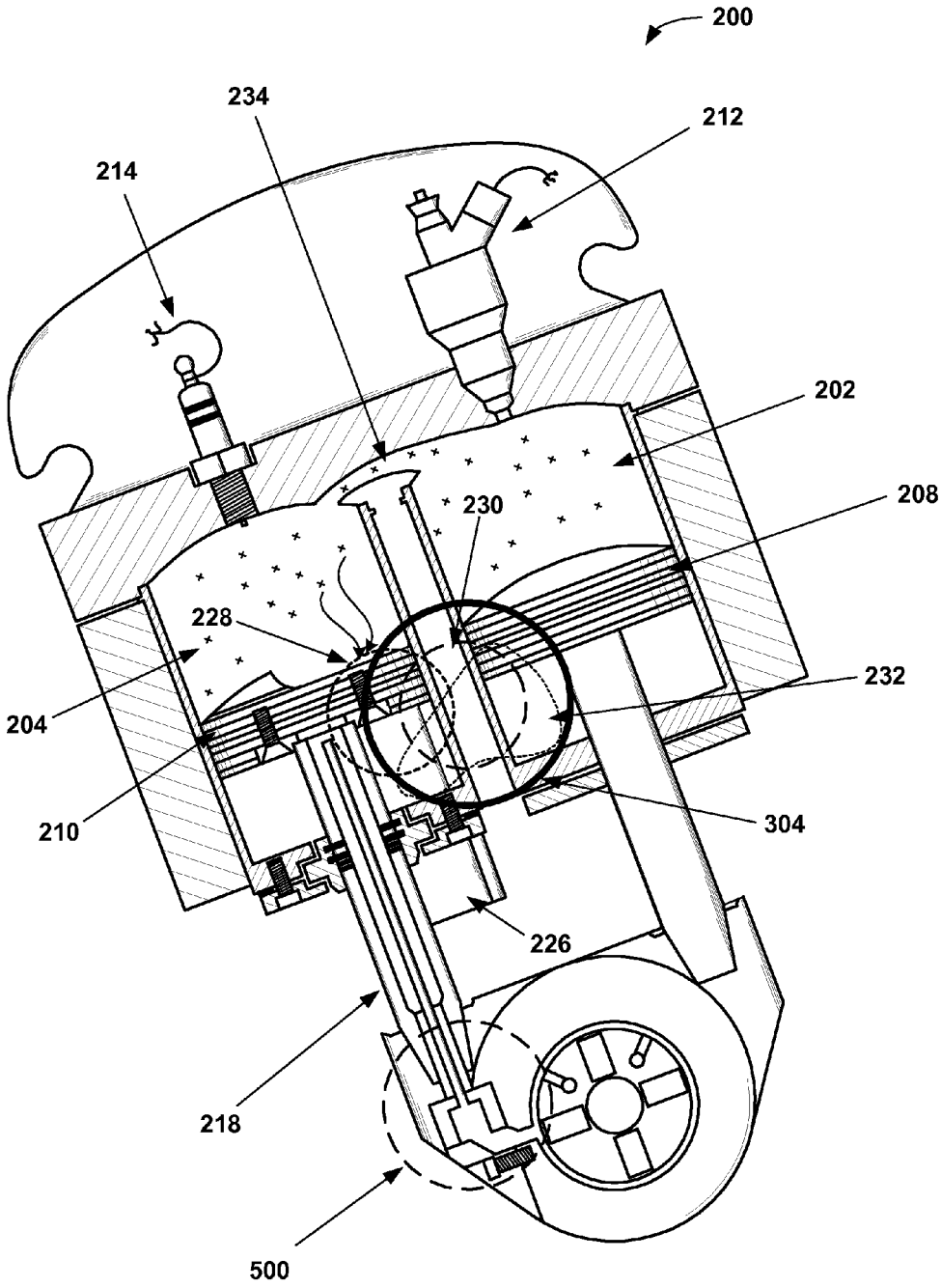
FIG. 5B illustrates a twin power unit at the beginning of a purge cycle, in accordance with an embodiment of the present invention.

Referring back to FIG. 4, the combustion exhaust gasses are expelled from the exhaust cylinder as the exhaust pistons clears the top portion of the exhaust port and the intake charge air is compressed beneath the pistons, in operation 406. FIG. 5B illustrates a twin power unit 200 at the beginning of a purge cycle, in accordance with an embodiment of the present invention. The purge cycle begins as the pistons 208/210 travel downward and the exhaust piston 210 begins to clear the exhaust port 228. At this point, as illustrated in FIG. 5B, the rod base bearing mount 220 of the rod assembly 218 is located at about 3:30 with respect to the crankshaft 500. FIG. 5B also illustrates the twin power unit's 200 rotation about the trunnion mount 304, allowing the pistons 208/210 and rod assembly 218 to follow the crankshaft 500 as it turns, without requiring a wrist pin.

During operation 406, the downward motion of the pistons 208/210 also drives the intake air present in both cylinders 202/204 below the pistons 208/210 back into the intake port 230 via the intake charge passage 232. However, the one-way reed valve present in the intake port 230 prevents the intake air from escaping out of the intake port 230. As a result, the downward motion of the pistons 208/210 compresses the intake air in the bottom portion of the cylinders 202/204 and portion of intake port 230 on the piston side of the reed valve.

Figure 5C:
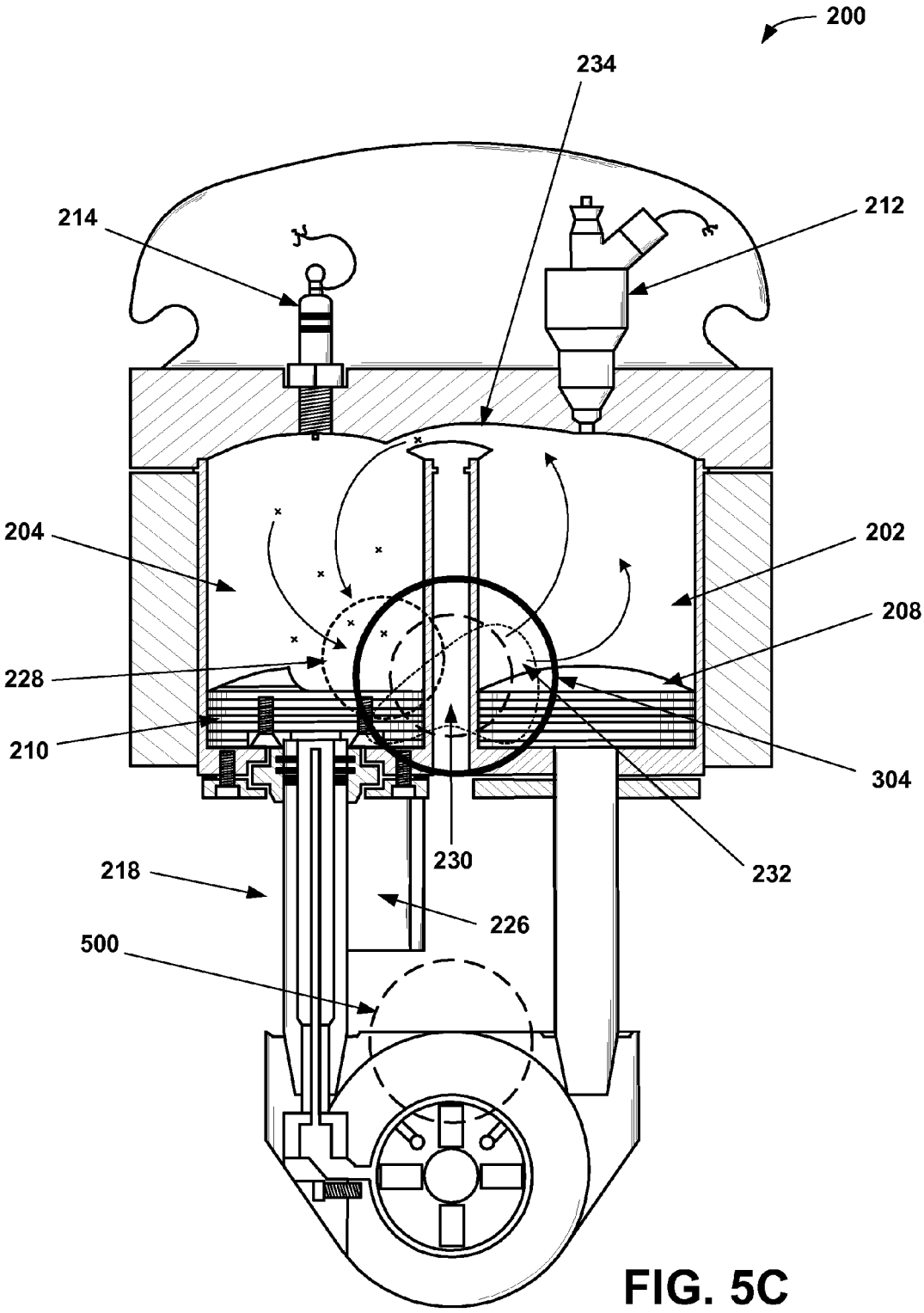
FIG. 5C is a diagram illustrating a twin power unit at the end of a purge cycle, in accordance with an embodiment of the present invention.

In operation 408, the compressed intake air is blasted into the intake cylinder via the intake charge passage. FIG. 5C is a diagram illustrating a twin power unit 200 at the end of a purge cycle, in accordance with an embodiment of the present invention. FIG. 5C illustrates the pistons 208/210 located at the bottom of the cylinders 202/204, when the rod base bearing mount 220 of the rod assembly 218 is located at about 6:00 with respect to the crankshaft 500. As the pistons 208/210 continue to travel downward, the intake piston 208 reveals the intake charge passage 232. The intake charge passage 232 is configured such that the intake piston 208 clears the top area of the intake charge passage 232 before the exhaust piston 210 during downward motion of the pistons 208/210. Once the top of the intake piston 208 drops below the top of the intake charge passage 232, the intake charge air compressed beneath the pistons 208/210, and in the portion of intake port 230 on the piston side of the reed valve 300, is blasted into the intake cylinder 202 above the intake piston 208. The rapid intake charge air blast purges the combustion exhaust gases from the intake cylinder 202, through the air-fuel crossover passage 234, through the exhaust cylinder 204, and out the exhaust port 228. The rapid intake charge air blast also purges the combustion exhaust gases from the air-fuel crossover passage 234 and the exhaust cylinder 204.

Figure 5D:
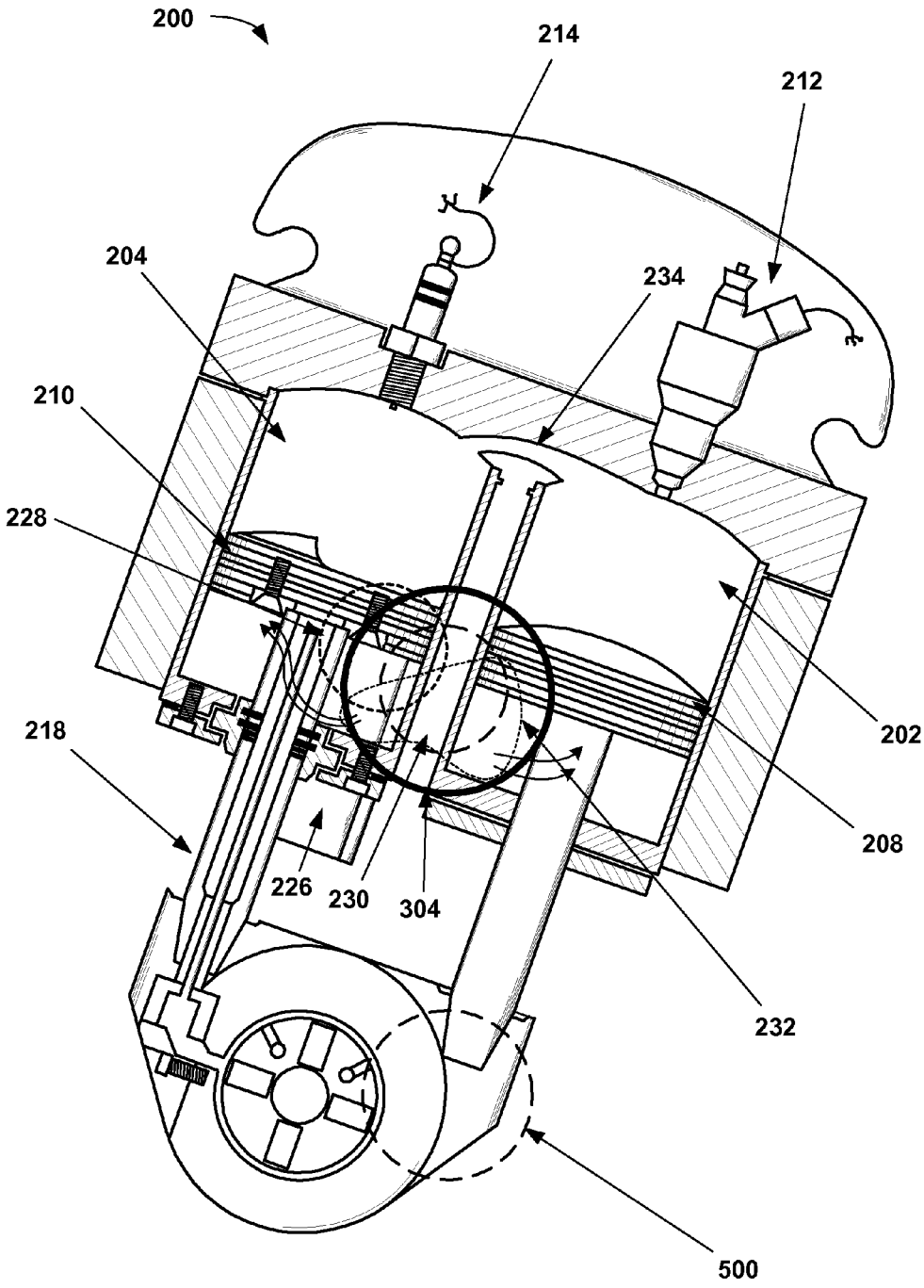
FIG. 5D is a diagram showing a twin power unit during a charge cycle, in accordance with an embodiment of the present invention.

Turing back to FIG. 4, intake charge air is drawn in below the pistons and the intake charge air present above the pistons is compressed, in operation 410. FIG. 5D is a diagram showing a twin power unit 200 during a charge cycle, in accordance with an embodiment of the present invention. FIG. 5D illustrates the pistons 208/210 located in the middle of the cylinders 202/204 as they rise, when the rod base bearing mount 220 of the rod assembly 222 is located at about 9:00 with respect to the crankshaft 500. As the pistons 208/210 begin to travel back upward, the intake charge air, forced via the upward motion of the pistons 208/210 further expels the combustion exhaust gases from the cylinders 202/204 before being compressed as the exhaust piston 210 covers the exhaust port 228. As the pistons 208/210 continue to rise, the fuel injector 212 delivers fuel to the intake cylinder 202 creating an air-fuel mixture. Because the simultaneous compression currently occurring within the top portions of the cylinders 202/204, a swirling effect is created mixing the fuel with the compressed air, creating an air-fuel mixture that also flows into the top portion of the exhaust cylinder 204 via the air-fuel crossover passage 234.

In addition, the intake piston 208 and exhaust piston 210 rise to reveal the intake charge passage 232. The rising movement of the pistons 208/210 draws in an air intake charge from the intake port 230, through the intake charge passage 232 and into the bottom portions of the cylinders 202/204 beneath the pistons 208/210. As discussed above, both the intake cylinder 202 and the exhaust cylinder 204 are fully enclosed, thus preventing the intake air from escaping. In addition, during operation 410 the exhaust piston skirt 226 covers the exhaust port 228, thereby preventing the intake air charge from escaping via the exhaust port 228.

Referring back to FIG. 4, post process operations are performed in operation 412. Post process operations can include, for example, continuing with further power cycles, purge cycles, and charge cycles, and other post process operations that will be apparent to those skilled in the art after a careful reading of the present disclosure. As will be appreciated, embodiments of the present invention advantageously allow power to be applied to crankshaft without the need of a wrist pin via the trunnion mount which allows the twin power unit to oscillate. In addition, the intake charge air compression and purge allows the efficient expulsion of combustion exhaust gases without the need of an external system. Moreover, the location of the exhaust port allows the exhaust piston and exhaust piston skirt to cover the exhaust port preventing any wasteful loss of air-fuel mixture. In addition, to utilizing compressed intake charge air beneath the pistons during the purge cycle, embodiments of the present invention can further utilize uncompressed intake air combined with an exhaust valve to provide combustion exhaust gas purging, as illustrated next with reference to FIG. 6.

Figure 6:
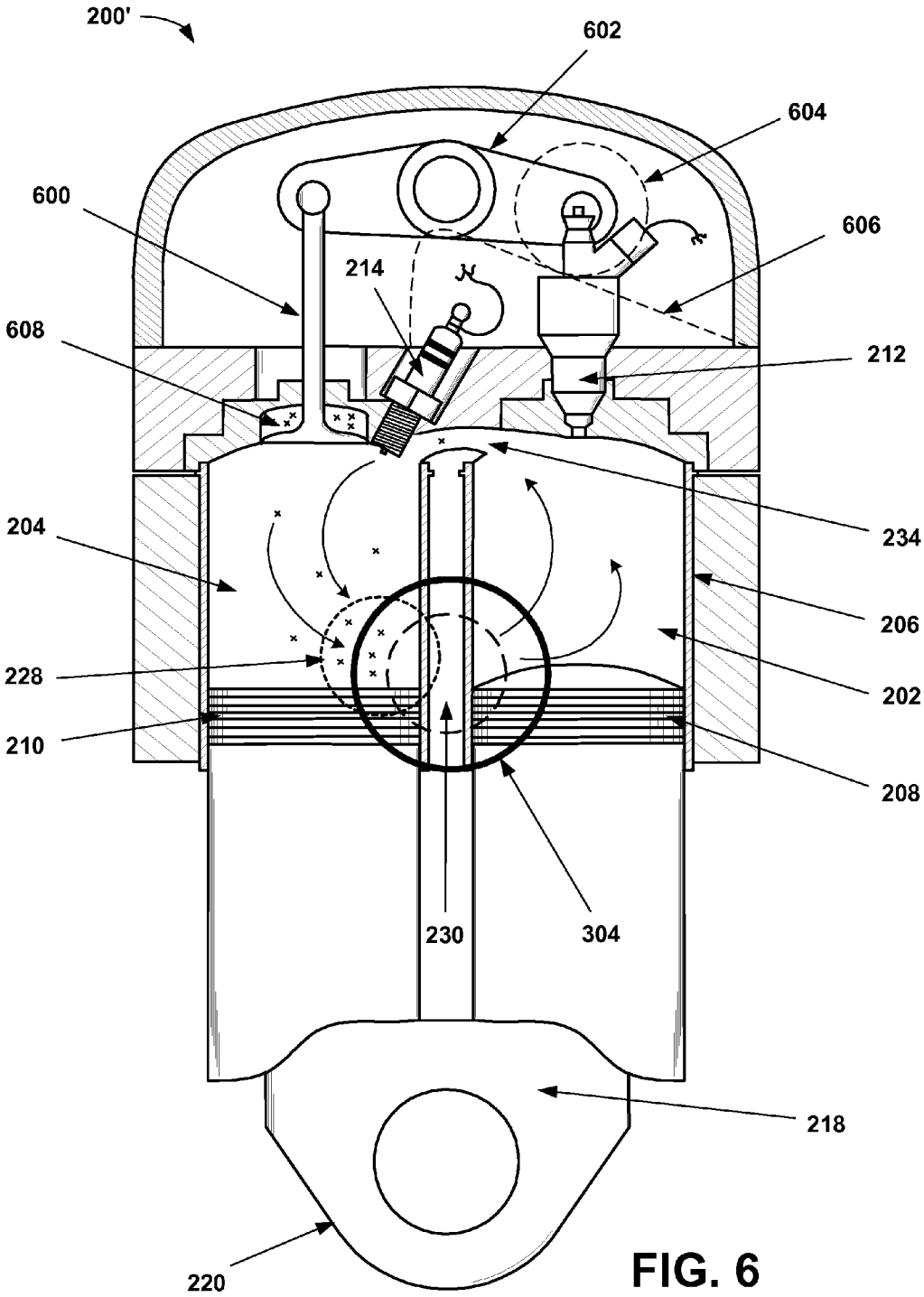
FIG. 6 is a diagram showing an oscillating cylinder twin power unit for an internal combustion engine utilizing an exhaust valve and rocker assembly for purging combustion exhaust gases, in accordance with an embodiment of the present invention.

FIG. 6 is a diagram showing an oscillating cylinder twin power unit 200' for an internal combustion engine utilizing an exhaust valve 600 and rocker assembly 602 for purging combustion exhaust gases, in accordance with an embodiment of the present invention. The exemplary twin power unit 200' of FIG. 6 includes an intake cylinder 202 and exhaust cylinder 204, each enclosing a piston sleeve 206 and connected via an air-fuel crossover passage 234. Located in the intake cylinder 202 is an intake piston 208, and disposed in the exhaust cylinder 204 is an exhaust piston 210. A fuel injector 212 is situated above the intake cylinder 202 and a spark plug 214 is located above and off center of the exhaust cylinder 204. Fixed below the pistons 208 and 210 is a rod assembly 218, which includes a rod base bearing mount 220. An exhaust port 228 out of the exhaust cylinder 204 and an intake port 230 providing air to the intake cylinder 202 also are included. In addition, an exhaust valve 600 is located above the exhaust cylinder 204 and is utilized to control the flow of combustion exhaust gas through the exhaust valve port 608. The exhaust valve 600 is moveably attached to a rocker assembly 602, which is further coupled to a rocker roller 604. The rocker roller 604 rest on a ramp cam 606 and moves along the ramp cam 606 during operation, as will be described subsequently.

Similar to the embodiment of FIG. 2, oscillating cylinder twin power unit 200' of FIG. 6 functions utilizing a power cycle, purge cycle, and charge cycle. The power cycle begins when the intake piston 208 and the exhaust piston 210 reach the top of the cylinders 202/204 and full compression is achieved. This occurs when the rod assembly 218 is at approximately 12 o'clock with respect to the crankshaft. The spark plug ignites the compressed air-fuel mixture powering the both pistons 208/210 and driving the pistons 208/210 and rod assembly 218 toward the crankshaft. As mentioned previously, during full compression, the compressed air-fuel mixture is present in the top portions of both the intake cylinder 202 and the exhaust cylinder 204, and also in air-fuel crossover passage 234. Hence, the spark plug 214 ignites the air-fuel mixture in the exhaust cylinder 202, which ignites the air-fuel mixture in the air-fuel crossover passage 234, which ignites the air-fuel mixture in the intake cylinder 202. As a result, both the exhaust piston 210 and the intake piston 208 are powered during the power cycle via the spark plug 214.

The purge cycle begins as the pistons 208 and 210 travel downward within the cylinders 202/204 and the twin power unit 200' begins to pivot about the trunnion mount 304 allowing the rod assembly 218 and pistons 208/210 to follow the rotation of the crankshaft via the crank journal. As the twin power unit 200' pivots about the trunnion mount 304, the rocker roller 604 begins to roll up the ramp cam 606. The ramp cam 606 is mounted outside the twin power unit 200' and remains in a fixed position as the twin power unit 200' pivots. The rocker roller 604 is coupled to the rocker assembly 602, which is attached to the twin power unit 200'. Hence, as the twin power unit 200' pivots, the rocking motion of the twin power unit 200' causes the rocker roller 604 to roll back and forth along the ramp cam 606. As the rocker roller 604 rolls up the ramp cam 606, the attached rocker assembly 602 causes the exhaust valve 600 to open. Then, as the rocker roller 604 rolls back down the ramp cam 606, caused by the twin power unit 200' pivoting in the opposite direction, the attached rocker assembly 602 allows the exhaust valve 600 to close.

In this manner, when the rod assembly 218 is located at about 3:00 with respect to the crankshaft, and the pistons 208/210 have traversed approximately half the distance to their bottom most position, the rocker roller 604 is positioned on the ramp cam 606 such that the rocker assembly 602 causes the exhaust valve 600 to open. The opening of the exhaust valve 600 allows the combustion exhaust gases in the upper portion of the cylinders 202/204 to escape the cylinders 202/204. In addition, as the pistons 208/210 continue travel downward within the cylinders 202/204, the exhaust the exhaust piston 210 begins to clear the exhaust port 228 when the rod assembly 218 reaches about 4:00 with respect to the crankshaft, allowing additional combustion exhaust gases to escape.

The charge cycle begins as the pistons travel further downward and the intake piston 208 begins to clear the intake port 230. At this point, a blower blast intake charge air into the intake cylinder 202 above the intake piston 208. The intake blast air helps purge the remaining combustion exhaust gases present in both the intake cylinder 202 and the exhaust cylinder 204. A bellows charges intake air through the intake port 230, up the intake cylinder 202, through the air-fuel crossover passage 234, and out the exhaust cylinder 204 through the exhaust port 228 and the past the open exhaust valve port 608. As can be appreciated, the twin power unit 200' of FIG. 6 uses slightly overlapping cycles, in that the purge cycle and charge cycle overlap to some extent. This continues as the pistons 208/210 reach their bottom most positions within the cylinders 202/204. The charge cycle and purge cycle continue as the pistons rise until the exhaust piston 210 covers the exhaust port 228 and the intake piston 208 covers the intake port 230. This occurs approximately when the rod assembly 218 reaches about 8:00 o'clock with respect to the crankshaft. At this time the rocker roller 604 rolls back down the ramp cam 606 causing the rocker assembly 602 to allow the exhaust valve 600 to close the exhaust valve port 608.

Compression starts when the rod assembly 218 reaches about 9:00 o'clock with respect to the crankshaft and the fuel injector 212 injects fuel into the intake cylinder 202. The intake charge air coupled with the compression from the rising pistons 2058/210 causes the fuel to efficiently mix with the compressed intake air charge creating an air-fuel mixture. In addition, part of the air-fuel mixture in the intake cylinder 202 flows into the air-fuel crossover passage 234 and into the exhaust cylinder 204, which at this point has all exhaust ports closed. Once the pistons 208/210 reach their top most positions within the cylinders 202/204, another power cycle begins with the spark plug 214 igniting the air-fuel mixture present in both cylinders 202/204 and the air-fuel crossover passage 234.

As those skilled in the art will appreciate after a careful reading of the present disclosure, embodiments of the present invention provide power on each revolution of the crankshaft. Moreover, the trunnion mount allows the twin power unit to oscillate back and forth across a small arc while tracking the rotational movement of the point of contact between the base on the rod assembly and the crankshaft. Hence, trunnion mount allows the twin power unit to oscillate such that the centerline of the pistons is at all times aligned with the crank throw of the crankshaft to eliminate lateral force vectors. The rigid fixed-length rod assembly connecting the pistons to the crankshaft causes the cylinders to oscillate while the pistons rotate semi-elliptically in their motion to turn the crankshaft. Since the rod assembly directly connects the pistons to the crankshaft, there is no need for a wrist pin and connecting rod. Furthermore, the below piston compressed intake air charge and reed valve design of the embodiment of FIG. 2 allows significant charging and purging of the cylinders without requiring outside assistance.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. An internal combustion engine twin power unit, comprising:

a first cylinder;

a second cylinder connected to the first cylinder via a crossover passage, wherein the crossover passage fluidly connects the first cylinder to the second cylinder;

a rod assembly connected to a first piston and a second piston, wherein the rod assembly rigidly fixes the first piston and the second piston in a fixed spatial relation to each other, and wherein the first piston is disposed in the first cylinder and the second piston is disposed in the second cylinder; and a trunnion mount, the trunnion mount allowing the twin power unit to oscillate such that a centerline of the pistons is at all times aligned with a crank throw of a crankshaft, wherein an air-fuel mixture introduced in the first cylinder is transferred to the second cylinder via the crossover passage, and wherein an ignition in any cylinder causes combustion of the air-fuel mixture in both cylinders via the crossover passage.

2. An internal combustion engine twin power unit as recited in claim 1, further comprising an intake port in fluid communication with the first cylinder and an exhaust port in fluid communication with the second cylinder, wherein air supplied to the first cylinder via the intake port is supplied to the second cylinder via the crossover passage.

3. An internal combustion engine twin power unit as recited in claim 2, wherein air is supplied to the first cylinder when the first piston clears the intake port, and wherein the air assist in expelling combustion exhaust gases from both cylinders out the exhaust port.

4. An internal combustion engine twin power unit as recited in claim 2, wherein both the first piston compresses air present in the first cylinder at essentially the same time as the second piston compresses air present in the second cylinder, and wherein the first piston covers the intake port and the second piston covers the exhaust port during compression.

5. An internal combustion engine twin power unit as recited in claim 1, wherein the combustion in both cylinders drives both the first piston and the second piston towards lower portions of the cylinders essentially simultaneously.

6. An internal combustion engine twin power unit having a first cylinder and a second cylinder, comprising:

a crossover passage fluidly connecting the first cylinder to the second cylinder, wherein an air-fuel mixture introduced in the first cylinder is transferred to the second cylinder via the crossover passage, and wherein an ignition in any cylinder causes combustion of the air-fuel mixture in both cylinders via the crossover passage;

a rod assembly connected to a first piston and a second piston, wherein the rod assembly rigidly fixes the first piston and the second piston in a fixed spatial relation to each other, and wherein the first piston is disposed in the first cylinder and the second piston is disposed in the second cylinder;

an intake port in fluid communication with both the first cylinder and the second cylinder;

a trunnion mount, the trunnion mount allowing the twin power unit to oscillate such that a centerline of the pistons is at all times aligned with a crank throw of a crankshaft; and a one-way valve controlling air passage within the intake port, wherein air drawn into the first cylinder and the second cylinder via the intake port below the first piston and the second piston is prevented from escaping either cylinder via the intake port during downward motion of the first piston and the second piston.

7. An internal combustion engine twin power unit as recited in claim 6, further comprising an intake charge passage disposed between the intake port and first cylinder and between the intake port and the second cylinder, the intake charge passage configured such that the first piston clears an area of the intake charge passage before the second piston during downward motion of the first piston and the second piston.

8. An internal combustion engine twin power unit as recited in claim 7, wherein air compressed below the first piston and the second piston during downward motion of the first piston and the second piston escapes into the first cylinder above the first piston via the intake charge passage when the first piston clears an area of the intake charge passage.

9. An internal combustion engine twin power unit as recited in claim 8, further comprising an exhaust port in fluid communication with the second cylinder.

10. An internal combustion engine twin power unit as recited in claim 9, wherein the compressed air escaping into the first cylinder via the intake charge passage purges combustion exhaust gases from both cylinders out the exhaust port.

11. An internal combustion engine twin power unit as recited in claim 6, wherein the combustion in both cylinders drives both the first piston and the second piston towards lower portions of the cylinders essentially simultaneously.

* * * * *